US010618290B2

(12) United States Patent
Kitamura et al.

(10) Patent No.: US 10,618,290 B2
(45) Date of Patent: Apr. 14, 2020

(54) INKJET HEAD MAINTENANCE DEVICE AND INKJET HEAD MAINTENANCE METHOD

(71) Applicant: TORAY ENGINEERING CO., LTD., Chuo-ku, Tokyo (JP)

(72) Inventors: Yoshiyuki Kitamura, Otsu (JP); Satoshi Tomoeda, Otsu (JP); Kazuyuki Shishino, Otsu (JP)

(73) Assignee: TORAY ENGINEERING CO., LTD., Tokyo (JP)

( * ) Notice: Subject to any disclaimer, the term of this patent is extended or adjusted under 35 U.S.C. 154(b) by 0 days.

(21) Appl. No.: 16/067,668

(22) PCT Filed: Dec. 26, 2016

(86) PCT No.: PCT/JP2016/088766

§ 371 (c)(1),
(2) Date: Jul. 2, 2018

(87) PCT Pub. No.: WO2017/119347

PCT Pub. Date: Jul. 13, 2017

(65) Prior Publication Data

US 2019/0016141 A1 Jan. 17, 2019

(30) Foreign Application Priority Data

Jan. 4, 2016 (JP) ..... 2016-000285

(51) Int. Cl.
*B41J 2/165* (2006.01)
*B41J 2/17* (2006.01)

(52) U.S. Cl.
CPC ..... *B41J 2/16552* (2013.01); *B41J 2/16532* (2013.01); *B41J 2/16535* (2013.01);
(Continued)

(58) Field of Classification Search
CPC ..... B41J 2/16532; B41J 2/16535; B41J 2/16552; B41J 2/1714; B41J 2/1721;
(Continued)

(56) References Cited

U.S. PATENT DOCUMENTS

2008/0186352 A1* 8/2008 Sasayama ..... B41J 2/16552 347/30
2010/0214357 A1* 8/2010 Maida ..... B41J 2/16552 347/28

(Continued)

FOREIGN PATENT DOCUMENTS

JP 2011-121295 A 6/2011
JP 2011-240624 A 12/2011

(Continued)

OTHER PUBLICATIONS

International Search Report of the corresponding International Application No. PCT/JP2016/088766, dated Jan. 31, 2017.

*Primary Examiner* — Anh T Vo
(74) *Attorney, Agent, or Firm* — Global IP Counselors, LLP

(57) ABSTRACT

An inkjet head maintenance device includes a base, a liquid supplier and a liquid collector. The base has an upper face disposed closely opposite a nozzle face of an inkjet head to form a liquid reservoir space during maintenance of the inkjet head. The base includes a liquid supply hole and a liquid collection hole that open to the upper face. The liquid supplier is configured to supply liquid from the liquid supply hole to the liquid reservoir space. The liquid collector is configured to collect the liquid in the liquid reservoir space from the liquid collection hole.

15 Claims, 7 Drawing Sheets

(52) U.S. Cl.
CPC .... *B41J 2/1721* (2013.01); *B41J 2002/16564* (2013.01); *B41J 2002/16594* (2013.01)

(58) Field of Classification Search
CPC ..... B41J 2/1728; B41J 2002/16564; B41J 2002/16594; B41J 2002/1742
See application file for complete search history.

(56) References Cited

U.S. PATENT DOCUMENTS

| | | | | |
|---|---|---|---|---|
| 2013/0057605 | A1* | 3/2013 | Miwa | B41J 29/38 347/6 |
| 2015/0042721 | A1* | 2/2015 | Mano | B41J 2/16541 347/33 |

FOREIGN PATENT DOCUMENTS

| | | | |
|---|---|---|---|
| JP | 2012-106448 | A | 6/2012 |
| JP | 2013-31962 | A | 2/2013 |
| JP | 2014-156009 | A | 8/2014 |

* cited by examiner

INKJET HEAD MAINTENANCE DEVICE AND INKJET HEAD MAINTENANCE METHOD

CROSS-REFERENCE TO RELATED APPLICATIONS

This application is a U.S. National stage of International Application No. PCT/JP2016/088766 filed on Dec. 26, 2016. This application claims priority to Japanese Patent Application No. 2016-000285 filed with Japan Patent Office on Jan. 4, 2016. The entire disclosure of Japanese Patent Application No. 2016-000285 is hereby incorporated herein by reference.

BACKGROUND

Field of the Invention

This invention relates to an inkjet head maintenance device and an inkjet head maintenance method.

Background Information

An inkjet head repeatedly discharges fine droplets numerous times, so a number of maintenance devices are required for stable operation. One of these is a cleaning device that keeps the nozzle face, which has ink droplet discharge ports, clean. For example, there is a known cleaning device in which cleaning is performed by bringing only a cleaning liquid into contact with the nozzle face of the inkjet head, rather than sliding or pressing a cleaning member against this face (see Japanese Patent Application Publication No. 2013-31962 (Patent Literature 1), for example).

With the inkjet head cleaning device disclosed in Patent Literature 1, a cleaning liquid holding surface formed on a cleaning liquid holding plate is disposed so that a cleaning liquid can be held in membrane form between itself and the inkjet head nozzle face that has undergone a liquid repellent treatment. The inkjet head nozzle face is moved over the cleaning liquid holding surface while in contact with the cleaning liquid held on the cleaning liquid holding surface. As a result, any ink adhering to the nozzle face or other such dirt is dissolved upon coming into contact with the cleaning liquid, and is removed from the nozzle face. Then, if the speed at which the inkjet head moves is being appropriately controlled, the liquid-repellent nozzle face will be separated as it moves over the cleaning liquid holding surface, so that the cleaning liquid containing the removed dirt does not adhere to the face, so ultimately the dirt on the nozzle face of the inkjet head is removed. That is, it is possible to clean away the dirt on the nozzle face of the inkjet head without coming into contact with the cleaning liquid holding face. The cleaning liquid containing dirt remains on the cleaning liquid holding surface, which has higher wettability than the nozzle face.

SUMMARY

With the inkjet head cleaning device described in Patent Literature 1, the movement of the inkjet head with respect to the cleaning liquid holding plate does indeed not leave any cleaning liquid on the nozzle face, which has undergone a liquid repellent treatment, but does leave cleaning liquid on the cleaning liquid holding surface, which has higher wettability. However, with a practical inkjet head, the nozzle face that has undergone the liquid repellent treatment protrudes markedly, and not only that, but the portion constituting the head lies in the same plane as the nozzle face around the nozzle face, or lies in a plane separated by from several dozen to several hundred microns. If we use "nozzle peripheral surface" to refer to the surface of the nozzle face around which the inkjet head is formed, the nozzle peripheral surface is usually not subjected to a liquid repellent treatment. Therefore, when the nozzle face in contact with the cleaning liquid moves and the nozzle peripheral surface adjacent in the movement direction of the nozzle face comes into contact with the cleaning liquid, the cleaning liquid that has not stuck to the nozzle face adheres to the nozzle peripheral surface and remains there. If an attempt is made to coat with the inkjet head while cleaning liquid containing dirt still remains on the nozzle peripheral surface, then when the nozzle face of the inkjet head is brought close to the substrate, the cleaning liquid remaining on the nozzle peripheral surface will adhere to the substrate, which means that the substrate ends up being defective, and coating with the inkjet head becomes impossible. Furthermore, some inkjet heads have grooves that divide the nozzle face from the nozzle peripheral surface, and when the nozzle face moves, the cleaning liquid is trapped and remains in these grooves. If a large amount of cleaning liquid is captured, some of the cleaning liquid will ooze out of the grooves and adhere not only to the nozzle peripheral surface but also to the nozzle face. The above problem is not encountered if the nozzle face and the nozzle peripheral surface lie in the same plane and the portion of the nozzle peripheral surface that is adjacent in the movement direction of the nozzle face is subjected to a liquid repellent treatment, and cleaning can be performed with the inkjet head cleaning device in Patent Literature 1, but the liquid repellent treatment surface area increases, and the inkjet head becomes very expensive. A single coating device makes use of a tremendous number of inkjet heads, and if a single inkjet head is very expensive, then the cost entailed by the coating device will be enormous, so increasing the liquid repellent treatment surface area is not a practical solution.

Furthermore, with the inkjet head cleaning device in Patent Literature 1, as described above, the nozzle face of the inkjet head is pulled away from the cleaning liquid containing dirt, but as the liquid repellency of the nozzle face decreases, it becomes extremely likely that dirt will reattach. In order to completely eliminate this possibility, the cleaning liquid containing the dirt on the cleaning liquid holding surface should be replaced with fresh cleaning liquid that does not contain dirt, but if fresh cleaning liquid is supplied from the cleaning liquid supply hole at one end of the cleaning liquid holding surface, the fresh cleaning liquid will overflow from the cleaning liquid holding surface in the vicinity of the cleaning liquid supply hole and not reach a distant position. Therefore, of the cleaning liquid containing dirt is only replaced with fresh cleaning liquid near the cleaning liquid supply hole, and most of it is not replaced. Therefore, it is still very likely that the dirt will reattach to the nozzle face, meaning that there is no improvement at all.

As described above, there is currently no inkjet head cleaning device for performing so-called non-contact cleaning, in which only a cleaning liquid is brought into contact with the nozzle face of an inkjet head, which can be applied to an inkjet head that has been put to practical use and is capable of high-quality cleaning that allows dirt to be effectively removed.

The present invention was conceived in an effort to solve the above problems, and its main object is to provide an inkjet head maintenance device and an inkjet head maintenance method, with which high-quality maintenance can be performed by effectively preventing liquid and dirt from adhering to and remaining on the nozzle face of any kind of inkjet head, and the surrounding area, during maintenance, such as non-contact cleaning in which only a liquid such as a cleaning liquid is brought into contact with the nozzle face of the inkjet head.

An inkjet head maintenance device according to this invention comprises a base that has an upper face disposed closely opposite the nozzle face of an inkjet head to form a liquid reservoir space during maintenance of the inkjet head, and includes a liquid supply hole and a liquid collection hole that open to the upper face; a liquid supply component that supplies liquid from the liquid supply hole to the liquid reservoir space; and a liquid collection component that collects the liquid in the liquid reservoir space from the liquid collection hole.

With this inkjet head maintenance device, the above configuration makes it possible to collect the liquid in the liquid reservoir space directly from the liquid collection hole. Consequently, the liquid in the liquid reservoir space can be collected so as not to remain on the nozzle face, in a state in which the inkjet head is stationary and does not move as in the past, so the cleaning liquid and dirt do not adhere to and remain on the nozzle peripheral surface that is outside the range of the liquid reservoir space around the nozzle face. As a result, non-contact cleaning in which dirt on the nozzle face is completely removed can be performed without causing the cleaning liquid or dirt to adhere to and remain on the nozzle face of the inkjet head or its surrounding portion. Therefore, problems can be eliminated in the operation of the inkjet head, such as when the ink (coating liquid) cannot be discharged from the inkjet head due to liquid or dirt remaining on the nozzle face after cleaning or other such maintenance, or when the liquid remaining on the nozzle face drips and adheres to the region in the course of movement from the maintenance position to the coating operation position.

In the above-mentioned inkjet head maintenance device, it is preferable if the base includes a liquid collection promotion means for accelerating the collection of the liquid. In this case, it is preferable if the liquid collection promotion means draws the liquid toward the liquid collection hole and comprises a first portion on the outside of the liquid collection hole and a second portion on the inside of the liquid collection hole, and the first portion is continuous with the second portion. With this configuration, due to the liquid attracting action of the liquid collection promotion means, which is generated when liquid flows down along the first portion and the second portion, the liquid held in the liquid reservoir space can be quickly drawn to a liquid collection hole of the liquid collection promotion means. As a result, the liquid collection promotion means can accelerate the collection of the liquid held in the liquid reservoir space, and the liquid can be collected in a short time.

Further, the above-mentioned the inkjet head maintenance device preferably further comprises a leaked liquid receptacle for collecting the liquid that leaks out from the liquid reservoir space. With this configuration, even when fresh liquid is supplied to the liquid reservoir space and the surplus liquid is pushed out so that a large amount leaks out, the leaked liquid can be easily collected in the leaked liquid receptacle.

The above-mentioned inkjet head maintenance device preferably further comprises a heating means for heating the upper face of the base. With this configuration, the liquid in the liquid reservoir space can be heated to raise its temperature. This makes it easy to dissolve or separate the coating liquid or dirt such as ink adhering to the nozzle face of the inkjet head in the high-temperature cleaning liquid. As a result, the heating means improves the cleaning of the inkjet head.

An inkjet head maintenance method according to this invention is a maintenance method that makes use of the inkjet head maintenance device described above, the method comprising a step of supplying a cleaning liquid for cleaning the nozzle face of the inkjet head from the liquid supply hole, and holding the cleaning liquid in the liquid reservoir space, and a step of collecting the cleaning liquid held in the liquid reservoir space from the liquid collection hole. The method preferably includes a step of simultaneously supplying the cleaning liquid from the liquid supply hole and collecting the cleaning liquid from the liquid collection hole.

With the inkjet head maintenance method according to this invention, the cleaning liquid in the liquid reservoir space to be cleaned can be collected directly from the liquid collection hole by performing the above steps. As a result, non-contact cleaning, in which dirt on the nozzle face is completely removed, can be performed without causing the cleaning liquid or dirt to adhere to and remain on the nozzle face of the inkjet head and its surrounding portion. Therefore, problems can be eliminated in the operation of the inkjet head, such as when the ink cannot be discharged from the inkjet head due to cleaning liquid or dirt remaining on the nozzle face after cleaning, or when the liquid remaining on the nozzle face drips and adheres to the region in the course of movement from the maintenance position to the coating operation position. Furthermore, by executing the step of simultaneously supplying the cleaning liquid from the liquid supply hole and collecting the cleaning liquid from the liquid collection hole, it is possible to collect the cleaning liquid containing the dirt held in the liquid reservoir space while supplying fresh cleaning liquid from the liquid supply hole. Consequently, the cleaning liquid containing the dirt is forced to flow toward the liquid collection hole by the fresh cleaning liquid, so the cleaning liquid containing dirt in the liquid reservoir space can be completely replaced with fresh cleaning liquid. If the cleaning liquid containing dirt that is held in the liquid reservoir space is merely collected, it becomes extremely likely that the dirt will reattach to the nozzle face, but because the cleaning liquid containing dirt in the liquid reservoir space can be collected after being replaced with fresh cleaning liquid, there is zero possibility that any dirt will reattach to the nozzle face. This makes possible high-quality cleaning in which dirt can be reliably removed.

Another inkjet head maintenance method according to this invention is a maintenance method that makes use of the inkjet head maintenance device described above, the method comprising a step of supplying a protective liquid for protecting the nozzle face of the inkjet head from the liquid supply hole, and holding the protective liquid in the liquid reservoir space, and a step of collecting the protective liquid after a certain amount of time has passed since it was held. The phrase "protecting of the nozzle face of the inkjet head" is a concept indicating that the nozzle face of the inkjet head is covered with a liquid membrane to break contact with the air so that air will not come into contact with and dry out the nozzle face or the ink discharge ports in the nozzle face, such as when the inkjet head is not used for an extended period of time.

With this other inkjet head maintenance method according to this invention, carrying out the above-described steps protects the nozzle face of the inkjet head and the ink discharge ports by covering them with the liquid, so drying and evaporation that occur through contact with air can be prevented over a very long period of time. Consequently, the inkjet head can be left on standby, preserved or stored for an extended period of time. Furthermore, it is also possible to resume the use of the inkjet head immediately after it comes out of these standby, preservation or storage.

Another inkjet head maintenance method according to this invention is a maintenance method that makes use of the inkjet head maintenance device described above, the method comprising a step of discharging a coating liquid from the inkjet head and holding the coating liquid in the liquid reservoir space, and a step of collecting the coating liquid held in the liquid reservoir space from the liquid collection hole.

With this other inkjet head maintenance method according to this invention, even when bleeding is performed, in which the coating liquid is discharged at high speed from the inkjet head in order to eliminate clogging caused by foreign substances adhering to the ink discharge ports, etc., performing the above steps makes it possible to prevent the coating liquid particles from being generated at the nozzle face or elsewhere during normal bleeding. Also, the discharged coating liquid can be collected without adhering to and remaining on the nozzle face, etc., still without generating any coating liquid particles.

With the inkjet head maintenance device and maintenance method of the present invention, as described above, the cleaning liquid or other such liquid held in the liquid reservoir space formed between the nozzle face of the inkjet head and the upper face of the base can be collected so that it does not remain on the inkjet head, in a state in which the inkjet head has been stopped with respect to the base. Consequently, during maintenance such as non-contact cleaning in which only the cleaning liquid or other such liquid is brought into contact with the nozzle face of the inkjet head, high-quality maintenance can be effectively carried out, without any liquid or dirt adhering to or remaining on the nozzle face or its surrounding portion, regardless of the type of inkjet head.

DETAILED DESCRIPTION OF EMBODIMENTS

Embodiments of the present invention will now be described through reference to the drawings.

First Embodiment

Configuration of Inkjet Maintenance Device

The configuration of a maintenance device 100*a* according to a first embodiment of the present invention will now be described through reference to FIG. 1.

Figure 1:
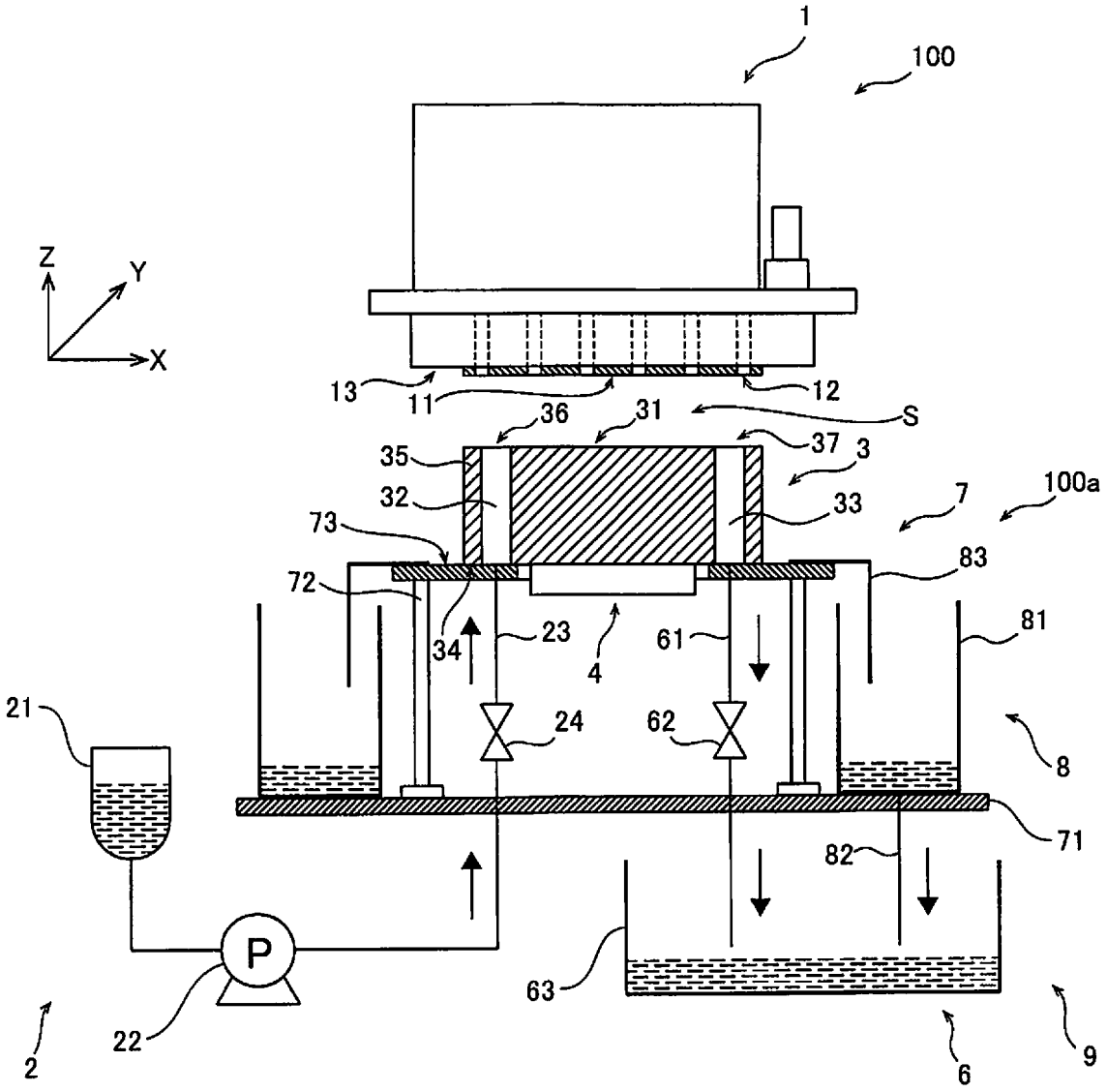
FIG. 1 is a simplified front cross section of the inkjet head maintenance device according to a first embodiment of the present invention.

Referring to FIG. 1, there is shown a maintenance device 100*a* for an inkjet head 1 according to a first embodiment of the present invention. The maintenance device 100*a* is a device that performs cleaning and other such maintenance on a nozzle face 11, which is the face that includes ink discharge ports 12 for discharging a coating liquid such as ink, and is configured as part of an inkjet coating device 100. For example, if the inkjet head 1 is performing coating at the other part of the inkjet coating device 100 (not shown) and there is so much dirt on the nozzle face 11, which is lower than the lower end face 13 of the inkjet head 1 by the thickness of the liquid repellent layer, that coating cannot continue, the inkjet head 1 starts moving toward the maintenance device 100*a*. Once the nozzle face 11 is cleaned by the maintenance device 100*a* to remove the dirt, the inkjet head 1 returns to its original location of the inkjet coating device 100, and the coating operation is resumed. The lower end face 13 is a nozzle peripheral face which is the portion around the nozzle face 11. The maintenance device 100*a* for the inkjet head 1 having a maintenance function including the above-mentioned cleaning is made up of a base 3, a support 7 for supporting the base 3, a liquid supply component 2 for supplying cleaning liquid to the base 3, a collection component 9 for collecting all of the cleaning liquid supplied to the base 3, and a heating means 4 for heating the base 3. Cleaning and other such maintenance operations are controlled by a control device consisting of a computer (not shown) that is a part of the inkjet coating device 100. Next, details of the various portions constituting the maintenance device 100*a* will be described in order.

First, an upper face 31 is provided on the upper part of the main body 35 of the base 3 immediately below the inkjet head 1. The upper face 31, which is formed substantially flat, can be opposite (across from) and a certain distance away from the nozzle face 11 of the inkjet head 1, and a liquid reservoir space S is formed between the two during maintenance of the inkjet head 1. Further, a liquid supply hole 32 and a liquid collection hole 33 that open at a part of the upper face 31 are provided in the interior of the main body 35 of the base 3. The liquid supply hole 32 and the liquid collection hole 33 are both through-holes that go through the main body 35 in the vertical direction (Z direction), and also open at the lower face 34, which is the opposite side from the upper face 31 in the vertical direction. The liquid supply hole 32 is connected to a liquid supply pipe 23 leading to the liquid supply component 2 at each opening in the lower face 34. The liquid collection hole 33 is connected to a liquid collection pipe 61 leading to a main collection tray 63 of a liquid collection component 6. The liquid collection part 6 is a part of the collection component 9, and collects the liquid in the liquid reservoir space S from the liquid collection hole 33. The liquid supply component 2 is made up of a storage tank 21 for storing cleaning liquid, a pump 22 for pumping a specific amount of cleaning liquid, and a pump valve 24 for determining whether the liquid is pumped or blocked through the liquid supply pipe 23 from the pump 22. With this configuration, the cleaning liquid stored in the storage tank 21 is supplied from the pump 22 to the base 3, and is discharged from an opening 36 in the upper face 31 of the liquid supply hole 32. Thus, the cleaning liquid discharged from the opening 36 in the upper face 31 of the liquid supply hole 32 is built up in the vertical direction while spreading over the entire upper face 31, and touches the nozzle face 11 to fill up the liquid reservoir space S. Then, the cleaning liquid is kept in this filled state by the surface tension of the cleaning liquid at the edge portion of the upper face 31 and the nozzle face 11, and the cleaning liquid is held in the liquid reservoir space S. At this point, if a collection valve 62 constituting the liquid collection component 6, which is connected downstream of the liquid collection pipe 61, is closed, the held cleaning liquid remains in the liquid reservoir space S. If the collection valve 62 is open, the cleaning liquid on the upper face 31 is collected from the opening 37 in the upper face 31 of the liquid collection hole 33, passes through first the liquid collection pipe 61 and then the collection valve 62, and falls into the main collection tray 63.

Also, the heating means 4 is fixed in close contact with the central portion in the X direction of the lower face 34 of the main body 35. The heating means 4 is a heater for heating the base 3, and a plate heater, a rubber heater, or the like can be favorably applied. Since the entire base 3 is heated by the heating means 4, the upper face 31 is also heated. Therefore, when the cleaning liquid is held in the liquid reservoir space S, the held cleaning liquid can be heated to a specific temperature. That is, the inkjet head maintenance device 100*a* further comprises the heating means 4 for heating the upper face 31 of the base 3.

Furthermore, the base 3 is supported by a support face 73 on the upper side of a portal frame 72 that is part of the support 7, at positions at both ends in the X direction of the lower face 34. The portal frame 72 itself is fixed on a base 71 that also is part of the support 7. On the base 71 is also fixed a sub-collection tray 81 that is part of a leaked liquid receptacle 8. The leaked liquid receptacle 8 is a portion of the collection component 9. As described above, when cleaning liquid is held in the liquid reservoir space S and then more cleaning liquid is supplied from the liquid supply hole 32, the filled state of the liquid cannot be maintained by the surface tension of the cleaning liquid, and some of the cleaning liquid in the liquid reservoir space S overflows and leaks out from the edge of the upper face 31 of the base 3 while maintaining the shape of the liquid held. The leaked cleaning liquid runs down along the side face of the main body 35, is guided by a guide plate 83 that serves as part of the leaked liquid receptacle 8 fixed to the end of the support face 73 of the portal frame 72, and is collected in the sub-collection tray 81. The sub-collection tray 81 is in the shape of nested boxes (that is, one rectangle within another) as viewed from the upper side, and reservoirs shown in two places in FIG. 1 communicate with each other. In other words, the reservoir of the sub-collection tray 81 is configured to surround the periphery of the base 3 and the portal frame 72 supporting that. Accordingly, the cleaning liquid collected in the sub-collection tray 81 falls runs down through a liquid discharge pipe 82 installed at just one location, and finally is collected in the main collection tray 63. Nearly all of the washing liquid supplied to the base 3 is collected and stored in the main collection tray 63, except for the part that evaporates, but it is preferable to discharge or discard the cleaning liquid once it reaches a certain amount or more. As described above, the maintenance device 100*a* for the inkjet 1 head further comprises the leaked liquid receptacle 8 for collecting the liquid that leaks out from the liquid reservoir space S.

Next, a method for cleaning the nozzle face 11, which is the inkjet head maintenance method of the present invention that makes use of the maintenance device 100*a* for the inkjet head 1, will now be described through reference to FIGS. 2A to 2F. FIGS. 2A to 2F are front cross sections (as seen in the Y direction) showing the inkjet head 1 shown in FIG. 1, a part of the base 3, and surroundings thereof in detail view. Also, steps S0 to S5 correspond to FIGS. 2A to 2F, and the situation during each step and the result of the operation of the various components are shown in the corresponding drawings. In the steps S, a larger numerical value means that the step is carried out later in time. Carrying out the steps S whose execution states are shown in FIGS. 2A to 2F corresponds to performing an inkjet head maintenance method that includes a step of supplying a cleaning liquid for cleaning the nozzle face 11 of the inkjet head 1 from the liquid supply hole 32 and holding it in the liquid reservoir space S, and a step of collecting the cleaning liquid held in the liquid reservoir space S from the hole 33. In addition to this, it also corresponds to performing an inkjet head maintenance method that involves a step of simultaneously supplying the cleaning liquid from the liquid supply hole 32 and collecting the cleaning liquid from the liquid collection hole 33. The steps S in FIGS. 2A to 2F will now be described in order.

Figure 2A:
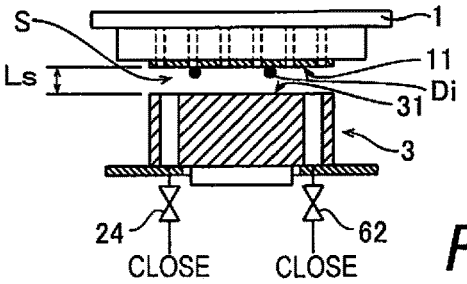
FIGS. 2A, 2B, 2C, 2D, 2E and 2F are diagrams illustrating the steps included in the inkjet head maintenance method according to the present invention.

Step S0 (the Situation in FIG. 2A)

This step is a preparatory step for cleaning the nozzle face 11. The inkjet head 1 finishes coating, moves to a position directly above the upper face 31 of the base 3 in order to clean the nozzle face 11 to which the ink or solidified ink has adhered and remains as dirt Di, and temporarily comes to a stop. At this point, the nozzle face 11 and the upper face 31 are in positions that are substantially superposed in the X and Y directions. That is, when looking at the nozzle face 11 and the upper face 31 in the Z direction, they appear to be substantially superposed one over the other. In this state, the inkjet head 1 is lowered in the vertical direction, which is the Z direction, and the inkjet head 1 is stopped at a position where the gap between the upper face 31 and the nozzle face 11 is the length Ls. This forms the liquid reservoir space S having a gap with the length Ls in between the upper face 31 and the nozzle face 11. At this point, the pump valve 24 and the collection valve 62 are both closed. The cleaning liquid fills everything from the storage tank 21 to the pump 22 and the pump valve 24 of the liquid supply pipe 23, and if the pump valve 24 is opened and the pump 22 is driven in this state, the cleaning liquid can be pumped to the base 3 at any time.

Figure 2B:
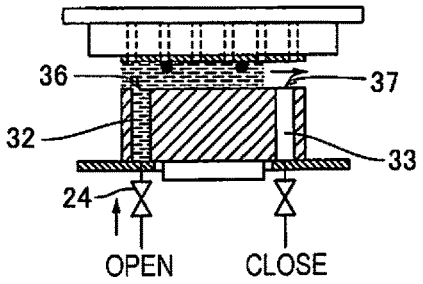

Step S1 (the Situation in FIG. 2B)

This is a step of filling the liquid reservoir space S with cleaning liquid (supplying the cleaning liquid to the space). After the pump 22 is driven and the pump valve 24 is opened, a specific liquid amount V1 (volume) of the cleaning liquid is pumped from the pump 22 at a specific flow rate Q1 (the amount of liquid per unit of time), and once the pumping is finished, the pump valve 24 is closed. Consequently, the cleaning liquid is discharged from the opening 36 of the liquid supply hole 32 in the upper face 31. Of the discharged cleaning liquid, the part heading to the left side on the upper face 31 and the part heading in a direction perpendicular to the viewing plane in the drawing temporarily come to a stop at the edge of the upper face 31 due to the action of surface tension. During this time, the cleaning liquid builds up on the upper face 31 and comes into contact with the nozzle face 11, and the cleaning liquid temporarily reaches a full state in the region around the opening 36 of the liquid supply hole 32 in the liquid reservoir space S. Of the cleaning liquid discharged from the opening 36 of the liquid supply hole 32, the part heading to the right side over the upper face 31, where the opening 37 of the liquid collection hole 33 is located, merges with the other parts, the filled region gradually expands to the right side (the state shown in FIG. 2B), and eventually the entire liquid reservoir space S becomes the region filled with cleaning liquid. When more cleaning liquid is supplied in this state, the filled state is maintained while the excess cleaning liquid leaks out from the edge of the upper face 31. The leaked cleaning liquid travels along the side face of the main body 35 and the guide plate 83, and heads toward the sub-collection tray 81. When pumping from the pump 22 is finished and the pump valve 24 is closed, the cleaning liquid that fills the entire liquid reservoir space S is subjected to the action of surface tension, and this filled state is maintained. This situation in which the filled state is maintained is one in which the liquid is being held.

Figure 2C:
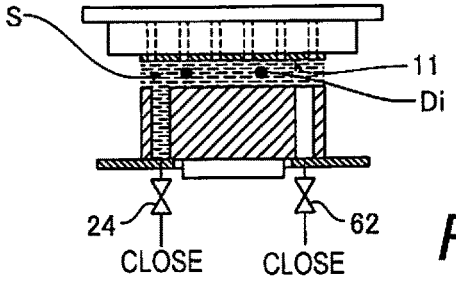

Step S2 (the Situation in FIG. 2C)

This is a cleaning step 1 (separation of dirt Di from nozzle face 11). When the pump valve 24 is closed and the collection valve 62 is closed, the filled state of the cleaning liquid in the liquid reservoir space S is maintained. This cleaning liquid filled state (liquid holding) is continued for a length of time t1. Any of the following may happen with the dirt Di in contact with the cleaning liquid during this time t1: (1) dirt Di in the form of a liquid is mixed into the cleaning liquid and diluted (contained in the cleaning liquid), (2) dried and solidified dirt Di is dissolved in the cleaning liquid, and (3) dried and solidified dirt Di it is not completely dissolved, but its adhesion to the nozzle face 11 is loosened and the dirt floats in the cleaning liquid. In other words the dirt Di is separated from the nozzle face 11 in one form or another.

Figure 2D:
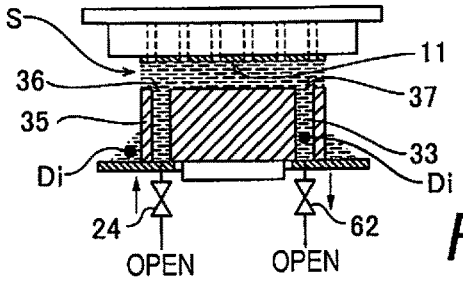

Step S3 (the Situation in FIG. 2D)

This is a cleaning step 2 (removal of the dirt Di that has been separated from the nozzle face 11). The pump 22 is again driven to open the pump valve 24, and then the cleaning liquid is pumped from the opening 36 to the liquid reservoir space S at a flow rate Q2. Immediately after this, the collection valve 62 is opened, and the cleaning liquid containing the dirt Di in the liquid reservoir space S is collected from the opening 37 and the liquid collection hole 33 (the state shown in FIG. 2D). After a specific length of time, the collection valve 62 is closed, and collection from the opening 37 and the liquid collection hole 33 is ended. Following this, the pump valve 24 is closed and the pump 22 is stopped. When the pumping of fresh cleaning liquid into the liquid reservoir space and the collection of the cleaning liquid containing the dirt Di are carried out simultaneously, the cleaning liquid containing the dirt Di that has filled the liquid reservoir space S is can be effectively replaced with the freshly pumped in cleaning liquid. That is, near the opening 36, the cleaning liquid containing the dirt Di that fills the liquid reservoir space S leaks out and is discharged from the edge of the upper face 31 of the base 3, being pushed out by the cleaning liquid that is freshly pumped in. This discharged cleaning liquid containing the dirt Di runs down the side face of the main body 35, is guided by the guide plate 83 and the support face 73 of the portal frame 72, and is collected in the sub-collection tray 81. Meanwhile, at a position farther away from the opening 36, the cleaning liquid containing the dirt Di that fills the liquid reservoir space S is pushed along the upper face 31 toward the opening 37 of the liquid collection hole 33 by the fresh cleaning liquid supplied from the opening 36, and as a result the cleaning liquid containing the dirt Di in the liquid reservoir space S is completely replaced with fresh cleaning liquid. Meanwhile, the cleaning liquid containing the dirt Di that has been pushed toward the opening 37 goes through the liquid collection hole 33, etc., and is collected in the main collection tray 63. The dirt Di contained in the cleaning liquid and the floating dirt Di are discharged from the liquid reservoir space S together with the cleaning liquid containing dirt that is discharged. As a result of the above, the dirt Di is removed from the nozzle face 11.

Figure 2E:
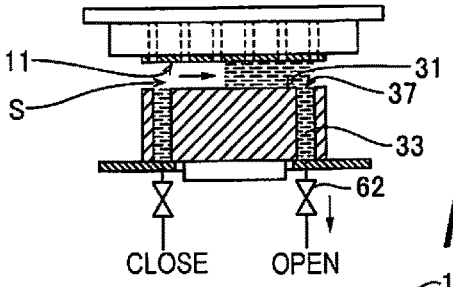

Step S4 (the Situation in FIG. 2E)

This is a step of collecting the cleaning liquid. The collection valve 62 is opened. As a result, the cleaning liquid that fills the liquid reservoir space S is collected from the opening 37 of the liquid collection hole 33. The collected cleaning liquid moves downward under the action of gravity toward the liquid collection hole 33, the liquid collection pipe 61, and the collection valve 62, in that order, and finally drops into the main collection tray 63, where it is held. The cleaning liquid that fills the liquid reservoir space S moves over the upper face 31 toward the opening 37 of the liquid collection hole 33 while in contact with the upper face 31 and the nozzle face 11 (the state shown in FIG. 2E). During this movement of the cleaning liquid, the cleaning liquid is repelled from the nozzle face 11 because the nozzle face 11 has undergone a liquid repellency treatment, so no cleaning liquid remains on the nozzle face 11. However, there are some areas of the upper face 31 that have not undergone this treatment and are still lyophilic, so a very small amount of cleaning liquid clings to the upper face 31 and remains. Also, if the freshly separated dirt Di remains in the cleaning liquid that fills the liquid reservoir space S, it goes through the opening 37 and is collected in the main collection tray 63 together with the cleaning liquid.

Figure 2F:
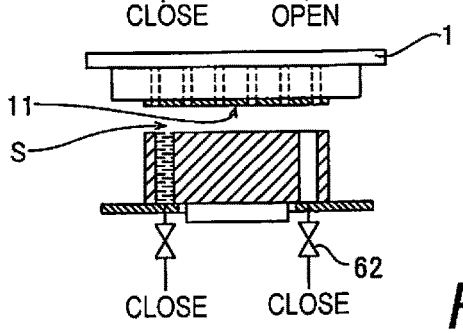

Step S5 (the Situation in FIG. 2F)

This is a completion step. Once all the cleaning liquid has been collected from the liquid reservoir space S, the collection valve 62 is closed. Since the dirt Di and the cleaning liquid used for removing the dirt Di have been completely removed from the nozzle face 11, the inkjet head 1 first rises for the next step, and then moves to a specific place.

Thereafter, as the inkjet head 1 continues coating and the dirt Di adheres to the nozzle face 11 again, steps S0 to S5 are repeated to perform cleaning in which the dirt Di is removed from the nozzle face 11. In the above maintenance method, step S2 (dissolving and separating the dirt Di) and step S3 (removing the separated dirt Di and replacing the cleaning liquid) may be repeated as needed. For example, when these steps are repeated twice, the steps are specifically executed as steps S0→S1→S2→S3→S2→S3→S4→S5. This makes it possible to separate the dirt Di, which takes time to dissolve, and further improves the cleaning. Alternatively, step S3 may be omitted so that the process includes steps S0→S1→S2→S4→S5. As a result, the dirt Di separated from the nozzle face 11 is collected in the main collection tray 63 from the opening 37 through the liquid collection pipe 61.

Any cleaning liquid may be used as long as it can dissolve the dirt Di and can separate it from the nozzle face 11, but organic solvents, water, alkaline solutions, and the like can be used to advantage. However, it is preferable to select one that will not damage the liquid repellent substance that imparts liquid repellency to the nozzle face 11. As for the material of the base 3, any material such as a metal, ceramic, synthetic resin, or the like may be used as long as it is resistant to the cleaning liquid to be used. Stainless steel or the like having corrosion resistance and resistance to water and organic solvents frequently used for cleaning liquids for inkjet heads is preferably used.

Furthermore, in order to reliably dissolve and separate the dirt Di in step S2, it is important to keep the cleaning liquid that fills the liquid reservoir space S stable, and what affects this most is the shape relationship between the nozzle face 11 and the upper face 31, and the length Ls, which is the gap therebetween. That is, when viewed in the Z direction, which is the vertical direction, and when the nozzle face 11 and the upper face 31 are superposed one over the other (when their centers in the X direction and the Y direction coincide), it does not matter which of the two is larger, but the difference in size in the X direction and the Y direction is preferably ±2 mm or less, and more preferably ±1 mm or less. As a result, the cleaning liquid that fills that the liquid reservoir space S is held within the respective shape ranges of the nozzle face 11 and the upper face 31, and the cleaning liquid will not ooze out from that range and adhere to the periphery of the nozzle face 11, for example.

The length Ls, which is the gap between the nozzle face 11 and the upper face 31, is preferably set to be at least 0.1 mm and no more than 2 mm, and more preferably at least 0.5 mm and no more than 1 mm. Within this range, the cleaning liquid continues to be stably held in a state of filling the storage space S (in a holding state).

Further, in steps S0 to S5, the heating means 4 may be operated to heat the base 3. In this case, in step S2, the cleaning liquid that fills the liquid reservoir space S is heated from the upper face 31 of the base 3, its temperature rises, and the dirt Di becomes more soluble and easier to separate from the nozzle face 11, the result being that cleaning is improved. The base 3 is preferably heated by the heating means 4 so that the cleaning liquid that fills the liquid reservoir space S is heated to at least 30° C. and no more than 50° C., more preferably at least 35° C. and no more than 45°.

Further, the pump 22 that pumps the cleaning liquid to the liquid reservoir space S can be a syringe pump, a Mohno pump, or the like, but it is preferable to use an intermittent metering pump such as a syringe pump, a diaphragm pump, a bellows pump that are sealed and allow for good metering. Furthermore, the pump 22 may be omitted from the liquid supply component 2, the storage tank 21 may be located above the storage space S in the vertical direction, and the cleaning liquid may be sent to the liquid reservoir space S by means of head difference. In this case, the liquid volume V1 to be sent is controlled depending on the magnitude of the head difference and how long the pump valve 24 is open. Furthermore, collection of the cleaning liquid held in the liquid reservoir space S from the opening 37 and the liquid collection hole 33 may be performed not by gravity but by using a suction pump or vacuum pressure. In this case, the collection rate and collection amount can be controlled. Further, when the nozzle face 11 and the upper face 31 are short in the X direction, the above step S3 may be replaced with the following step S3'.

Step S3'

This is the cleaning step 2 (removal of dirt Di separated from the nozzle face 11). The pump 22 is driven again to open the pump valve 24, and then the cleaning liquid is pumped to the liquid reservoir space S at a liquid amount V2 and a flow amount Q2. When the pumping ends, the pump valve 24 is closed. If the nozzle face 11 and the upper face 31 are short in the X direction, and the liquid reservoir space S is short in the X direction, then the cleaning liquid containing the dirt D that fills the liquid reservoir space S will replaced with freshly supplied cleaning liquid as a result of this pumping of fresh cleaning liquid into the liquid reservoir space. That is, all of the cleaning liquid containing the dirt Di that fills the liquid reservoir space S leaks out and is discharged from the edge of the upper face 31 of the base 3, being pushed out by the cleaning liquid that is freshly pumped in. The dirt Di contained in the cleaning liquid and the floating dirt Di are discharged from the liquid reservoir space S together with the cleaning liquid containing dirt that is discharged. As a result of the above, the dirt Di is removed from the nozzle face 11.

Effect of First Embodiment

The inkjet head maintenance device 100*a* according to the first embodiment described above comprises the base 3 that has the upper face 31 disposed closely opposite the nozzle face 11 of the inkjet head 1 to form the liquid reservoir space S during maintenance of the inkjet head, and includes the liquid supply hole 32 and the liquid collection hole 33 that open to the upper face; the liquid supply component 2 that supplies liquid from the liquid supply hole 32 to the liquid reservoir space S; and the liquid collection component 6 that collects the liquid in the liquid reservoir space S from the liquid collection hole 33. The maintenance device 100*a* having this basic configuration and the maintenance method that makes use of this device afford the following effects.

When the maintenance device 100*a* is used to perform when cleaning, which is a type of maintenance, first cleaning liquid is supplied from the supply hole 32 of the base 3 into the liquid reservoir space S formed between the upper face 31 of the base 3 and the nozzle face 11 of the inkjet head 1, and is held in this space. Then, the dirt Di clinging to the nozzle face 11 is separated by the cleaning liquid and contained therein, after which the cleaning liquid containing the dirt Di is collected. Consequently, the dirt Di clinging to the nozzle face 11 can be removed in a non-contact manner. Finally, the cleaning liquid remaining in the liquid reservoir space S is collected from the liquid collection hole 33. As a result, the cleaning liquid moves along the nozzle face 11 and the upper face 31 toward the opening 37 of the liquid collection hole 33 on the upper face 31. At the tail end of the moving bulk of cleaning liquid, the cleaning liquid is repelled by the nozzle face 11, which has undergone a liquid repellency treatment, so it does not remain on the nozzle face 11 and moves in bulk to the opening 37. In this way, it is possible to collect the cleaning liquid in the liquid reservoir space S so that it does not remain on the nozzle face 11, in a state in which the inkjet head 1 is stationary and does not move with respect to the base 3. Furthermore, since the above process can be performed without bringing the cleaning liquid into contact with any other portion of the inkjet head 1 besides the nozzle face 11, the cleaning liquid and the dirt Di do not adhere to and remain on the portion around the nozzle face 11, such as the lower end face 13. As a result, non-contact cleaning, in which the dirt Di on the nozzle face 11 is completely removed, can be carried out without causing the cleaning liquid and dirt to adhere to and remain on the nozzle face of the inkjet head or its surrounding portion. Consequently, problems can be eliminated in the operation of the inkjet head 1, such as when the ink (coating liquid) cannot be discharged from the inkjet head 1 due to liquid or dirt remaining on the nozzle face 11 after maintenance, or when the liquid remaining on the nozzle face 11 drips and adheres to the region in the course of movement from the maintenance position to the coating operation position.

Furthermore, supplying fresh cleaning liquid from the liquid supply hole 32 is performed with collecting the cleaning liquid containing the dirt Di from the liquid collection hole 33. Consequently, the cleaning liquid containing the dirt Di is pushed toward the liquid collection hole by the fresh cleaning liquid, so the cleaning liquid containing the dirt Di that is held in the liquid reservoir space S can be completely replaced with fresh cleaning liquid. As a result, although if the cleaning liquid containing dirt that is held in the liquid reservoir space S is merely collected, it becomes extremely likely that the dirt Di will reattach to the nozzle face, because the cleaning liquid containing dirt Di in the liquid reservoir space S can be collected after being replaced with fresh cleaning liquid, there is zero possibility that any dirt Di will reattach to the nozzle face. This makes possible high-quality cleaning in which dirt can be reliably removed.

Also, the maintenance device 100*a* according to the first embodiment is provided with the leaked liquid receptacle 8 for collecting the liquid that has leaked out from the liquid reservoir space S through the peripheral edge of the base 3. With this configuration, when the liquid reservoir space S is filled with cleaning liquid or cleaning liquid that contains dirt, for example, fresh cleaning liquid is supplied to the liquid reservoir space S, and even if a large quantity of excess cleaning liquid or the like leaks out from the liquid reservoir space S, it can be easily collected in sub-collection tray 81 constituting the leaked liquid receptacle 8.

Furthermore, with the maintenance device 100*a* of the first embodiment, since the heating means 4 is provided for heating the upper face 31 of the base 3, the liquid in the liquid reservoir space S in contact with the upper face 31 can be heated and its temperature raised. This makes it easy to raise the temperature of the cleaning liquid so as to dissolve or separate the ink or other such coating liquid and dirt that adhere to and solidify on the nozzle face 11 of the inkjet head 1. That is, the heating means 4 improves the cleaning of the inkjet head.

Second Embodiment

Figure 3:
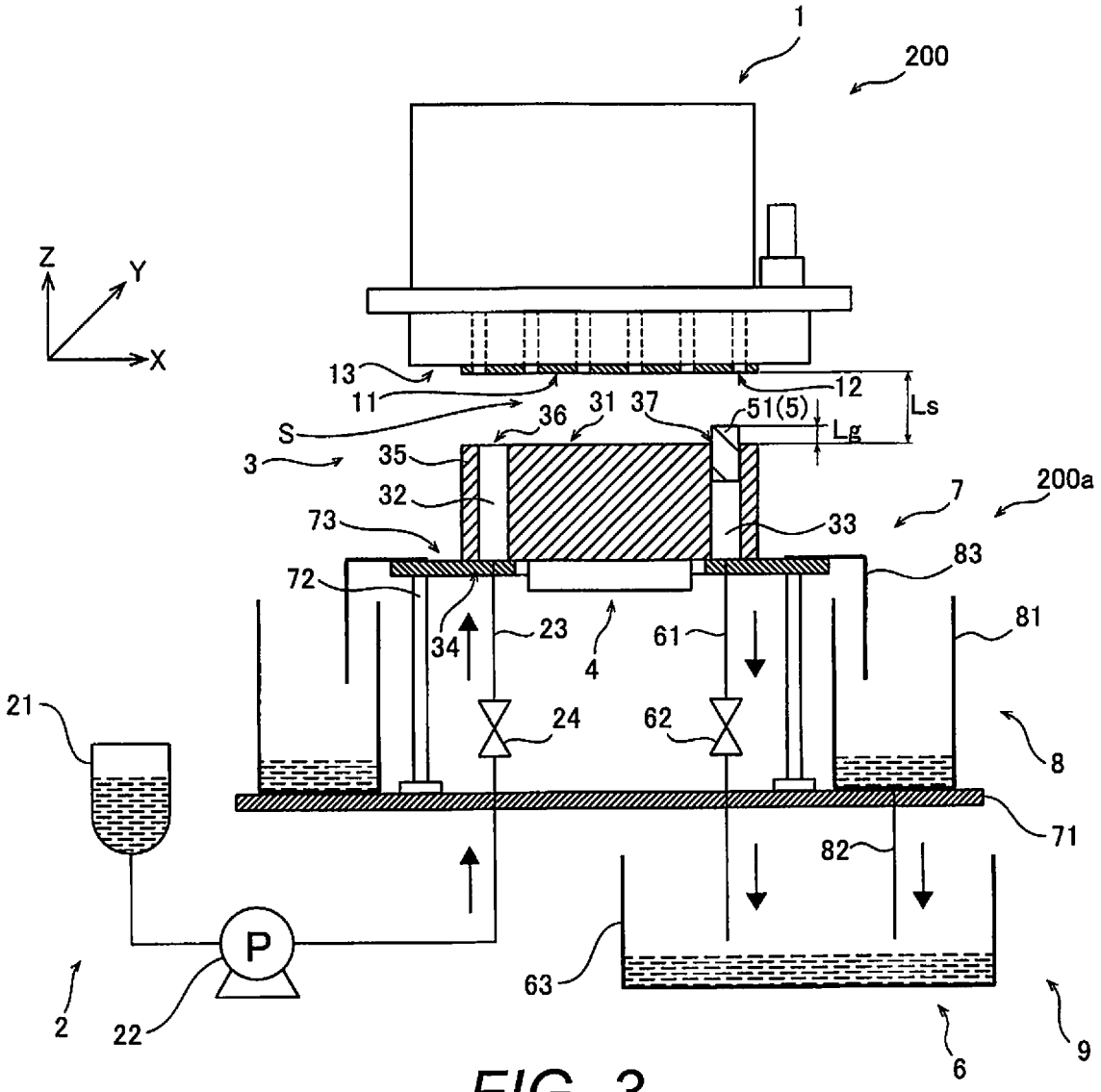
FIG. 3 is a simplified front cross section of the inkjet head maintenance device according to a second embodiment of the present invention.

The configuration of a maintenance device 200*a* of the inkjet head 1 according to a second embodiment of the present invention will now be described through reference to FIGS. 3 and 4. FIG. 3 is a simplified front cross section of the maintenance device 200*a*, and FIGS. 4A and 4B are detail views of the maintenance device 200*a*.

Referring to FIG. 3, the maintenance device 200*a* is a part of an inkjet coating device 200, and it is exactly the same as the maintenance device 100*a* except that a collection attracting member 51 is added to the opening 37 of the liquid collection hole 33 of the base 3. The collection attracting member 51 attracts the liquid to the liquid collection hole 33 having the opening 37, and serves as a liquid collection promotion means 5 for accelerating the collection of liquid. That is, the maintenance device 200*a* for the inkjet head 1 is such that the base 3 includes the liquid collection promotion means 5 for accelerating the collection of liquid. FIG. 4A is a detail plan view of the collection attracting member 51, which is the liquid collection promotion means 5, and the vicinity thereof as seen from above in the vertical direction, and FIG. 4B is a detail front cross section thereof. Referring to FIG. 4B, the collection attracting member 51 has a rectangular shape, and is made up of an upper portion (first portion) 53 located above the opening 37 (upper face 31) in the vertical direction (Z direction), and a lower portion (second portion) 54 located below the opening 37 (upper face 31). The lower portion 54 accounts for approximately two-thirds of the entire surface area of the collection attracting member 51, and is completely contained within the liquid collection hole 33. The upper portion 53 is connected to the lower portion 54 in the Z direction at the same width W (X direction length). Referring to FIG. 4A, the collection attracting member 51 is a flat member having a thickness T, and the upper portion 53 is depicted as being connected to and superposed with the lower portion 54 in the Z direction at the same thickness T (Y direction length). That is, the collection attracting member 51, which is the liquid collection promotion means 5, has the upper portion 53, which is a first portion on the outside of the liquid collection hole 33, and the lower portion 54, which is a second portion on the inside of the liquid collection hole 33. Further, the upper portion 53, which is the first portion, is connected to the lower portion 54, which is the second portion. Referring to FIG. 4A, the surface area of the collection attracting member 51 is smaller than the surface area of the opening 37 (the entrance to the liquid collection hole 33), and in between the collection attracting member 51 (linear), and the opening 37 and the liquid collection hole 33 (circular) there is a gap through which liquid flows in the direction (Z direction) perpendicular to the viewing plane in the drawing. Referring to FIG. 4B, a lower side portion 56, which is the end portion on the left side (the side having the opening 36 in FIG. 3) of the lower portion 54, is in contact with the entire edge of the opening 37 and with the inner face of the liquid collection hole 33, but may instead not be in contact at all. Furthermore, the shapes of the lower side portion 56 and the liquid collection hole 33 may be set so that their inner faces are partially in contact. This is because the state of contact between the lower side portion 56 and the inner faces of the liquid collection hole 33 and the opening 37 does not affect how the collection attracting member 51 attracts the liquid. Also, the upper end 52, which is the uppermost part of the upper portion 53 protruding from the upper face 31, may be brought into contact with the nozzle face 11 of the inkjet head 1, but the length Lg in the vertical direction (Z direction) from the upper face 31 to the upper end 52 (the protrusion amount Lg) is preferably set to at least 30% and no more than 90% of the vertical length Ls of the liquid reservoir space S. If the upper side portion 55, which is the end of the upper portion 53 on the left side, has this length Lg, then the liquid that fills the liquid reservoir space S can be efficiently drawn toward the liquid collection hole 33 by the upper side portion 55 and the upper end 52. This drawing action of the collection attracting member 51 promotes collection of the cleaning liquid and allows the collection to be completed in a short time. The force with which the liquid is drawn toward the liquid collection hole 33 by the upper end 52 and the upper side portion 55 (part of the upper portion 53) is generated when the liquid flows down along the flat surfaces of the upper portion 53 and the lower portion 54. The shape of the lower portion 54 in the liquid collection hole 33 as viewed in the Y direction may be any shape, such as a triangle, a trapezoid, a polygon, a circle, or an ellipse, as long as it is within the liquid collection hole 33. There are no particular restrictions on the length of the lower portion 54 in the vertical direction, but from the standpoints of the length over which the cleaning liquid flows and ease of installation, it is preferably at least 1 mm and no more than 20 mm, and more preferably at least 5 mm and no more than 15 mm. The shape of the upper portion 53 protruding from the upper face 31 as viewed in the Y direction may be any shape, as long as it is contiguous with the lower portion 54, but examples include triangular, trapezoidal, polygonal, circular, and elliptical. The upper portion 53 may have a shape in which the length in the X direction is greater than the diameter of the opening 37 of the liquid collection hole 33, examples of which include rectangular and trapezoidal.

Figure 4A:
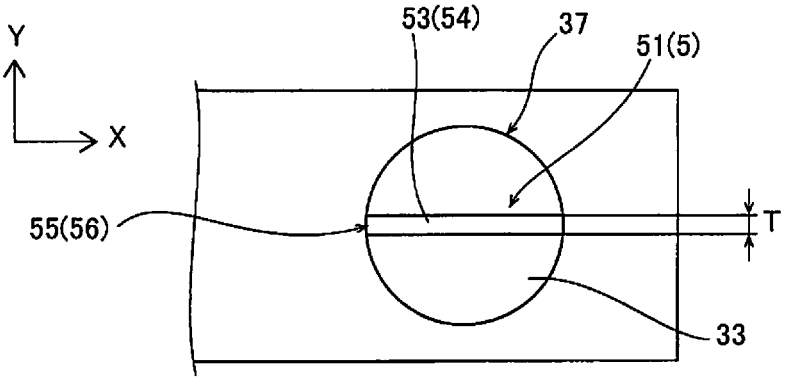
FIGS. 4A and 4B are detail views of a maintenance device 200*a;*
Figure 4B:
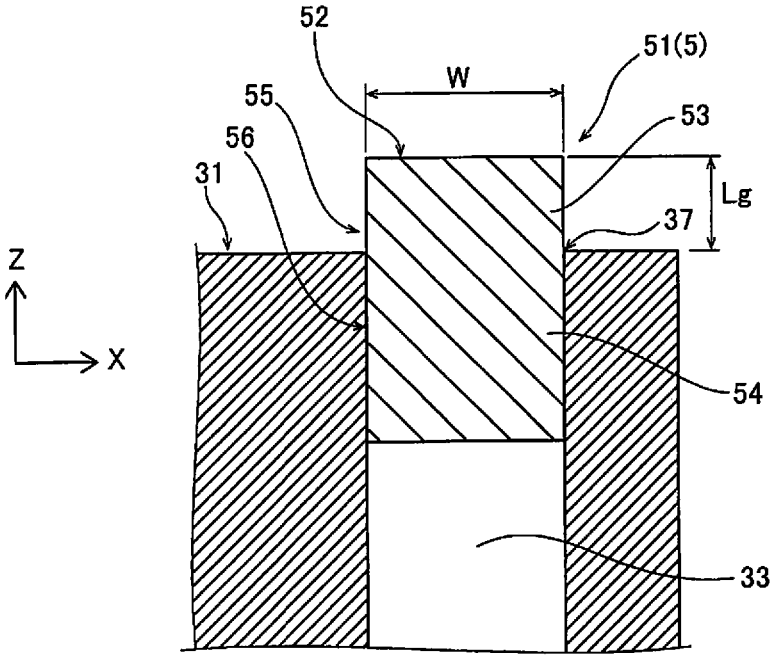

The collection attracting member 51 shown in FIGS. 3, 4A and 4B is a plate-like object, but the same action and effect can be obtained with a thread-like object. In the case of a thread-like object, it may have a shape that is bent midway, regardless of the lower portion 54 in the liquid collection hole 33 or the upper portion 53 protruding from the upper face 31. Furthermore, the upper portion 53 may bend and protrude in the X and Y directions from the opening 37. Furthermore, the upper portion 53 may be bent by 90 degrees or more with respect to the Z axis, and all or part of it may be touching the upper face 31. Further, the shape of the collection attracting member 51 as viewed from above in the vertical direction (the shape in the XY plane) may be any shape, such as linear, circular, a double circular shape, elliptical, polygonal including triangular, a U shape, a V shape, a Y shape, a box shape that is open on one side (a shape obtained by rotating a U shape 90 degrees), a # shape, or the like. Also, a plurality of collection attracting members 51 may be provided in the liquid collection hole 33, regardless of whether they are plate shaped or thread shaped. The method for cleaning the nozzle face 11, which is an inkjet head maintenance method that makes use of the maintenance device 200*a*, may be carried out by the steps S0 to S5 described through reference to FIGS. 2A to 2F, without modification. In particular, in steps S3 and S4, since the rate at which the cleaning liquid that fills the liquid reservoir space S is collected can be raised very high due to the action and effect of the collection attracting member 51, which is the liquid collection promotion means, steps S3 and S4 can be completed in a very short time, and as a result, the maintenance time can be extremely short. Also, when the collection attracting member 51 is a plate-like object, the thickness T thereof is preferably at least 0.05 mm and no more than 1 mm, and more preferably at least 0.1 mm and no more than 0.5 mm, in order to be rigid enough to hold its own shape, and to ensure enough clearance for the liquid to pass through between itself and the liquid collection hole 33.

Action and Effect of Second Embodiment

With the maintenance device 200*a* according to the second embodiment, the base 3 is configured to include the liquid collection promotion means 5 for accelerating the collection of liquid. More specifically, the collection attracting member 51, which is the liquid collection promotion means 5, is added to the opening 37 of the liquid collection hole 33 of the base 3. The collection attracting member 51 is plate-shaped, and comprises the upper portion 53, which is a first portion on the outside of the liquid collection hole 33, and the lower portion 54, which is a second portion on the inside of the liquid collection hole 33, and the upper portion 53 has a shape that is contiguous with the lower portion 54. Consequently, the liquid outside the liquid collection hole 33 flows down along the upper portion 53 and the lower portion 54 and is collected inside the liquid collection hole 33, which generates a force that draws the liquid at the upper portion 53 of the collection attracting member 51. The liquid attracting action of the collection attracting member 51 allows the liquid that fills and is held in the liquid reservoir space S to be drawn more quickly along the upper face 31 toward the liquid collection hole 33 where the collection attracting member 51 is located. Therefore, the collection attracting member 51, which is the liquid collection promotion means 5, can accelerate the collection of the liquid held in the liquid reservoir space S, and the liquid can be collected in less time.

Next, an extended standby method for an inkjet head 1, which is another inkjet head maintenance method that makes use of the maintenance device 100*a* or the maintenance device 200*a*, will be described through reference to FIGS. 5A to 5E. FIGS. 5A to 5E consist of diagrams illustrating this extended standby method for the inkjet head 1. FIGS. 5A to 5E are front cross sections (as seen in the Y direction) showing detail views of a part of the inkjet head 1 and the base 3 shown in FIG. 1, and the surrounding area. Also, the situation during each step and the results of the operation of the various components are shown in corresponding diagrams, with steps SW0 to SW4 corresponding to FIGS. 5A to 5E. In the steps SW, a larger numerical value means that the step is carried out later in time. Carrying out the steps SW whose execution states are shown in FIGS. 5A to 5E corresponds to performing an inkjet head maintenance method that includes a step of supplying a protective liquid for protecting the nozzle face 11 of the inkjet head 1 from the liquid supply hole 32 and holding it in the liquid reservoir space S, and a step of collecting the protective liquid a certain length of time after holding of the liquid. The steps SW in FIGS. 5A to 5E will now be described in order.

Figure 5A:
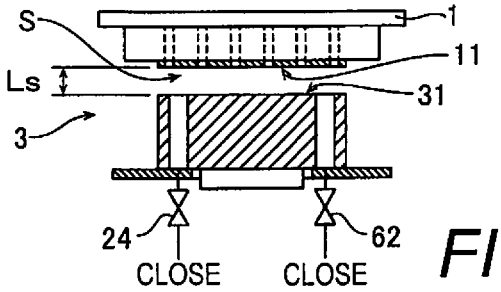
FIGS. 5A, 5B, 5C, 5D, and 5E are diagrams illustrating the steps included in another inkjet head maintenance method according to the present invention.

Step SW0 (the Situation in FIG. 5A)

This is a preparatory step for carrying out an extended standby method for an inkjet head, which is another maintenance method of the present invention. The inkjet head 1 moves to a position directly above the upper face 31 of the base 3 and temporarily stops there for extended standby. Then, the inkjet head 1 is lowered in the vertical direction, and the inkjet head 1 is stopped at a position where the gap between the upper face 31 and the nozzle face 11 is the length Ls. This forms the liquid reservoir space S having a gap with the length Ls in between the upper face 31 and the nozzle face 11. At this point, the pump valve 24 and the collection valve 62 are both closed. The cleaning liquid (protective liquid) fills everything from the storage tank 21 to the pump 22 and the pump valve 24 of the liquid supply pipe 23, and if the pump valve 24 is opened and the pump 22 is driven in this state, the cleaning liquid can be pumped to the base 3 at any time.

Figure 5B:
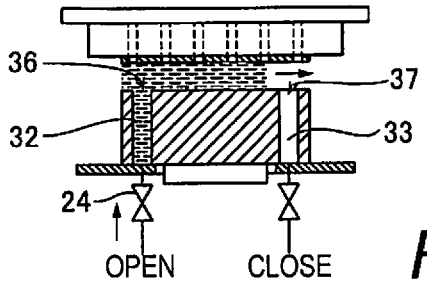

Step SW1 (the Situation in FIG. 5B)

This is a step of filling the liquid reservoir space S with cleaning liquid, and is exactly the same as step S1 above. Finally, the cleaning liquid, which is the protective liquid, supplied from the liquid supply hole 32 fills the entire area of the liquid reservoir space S and is held therein.

Figure 5C:
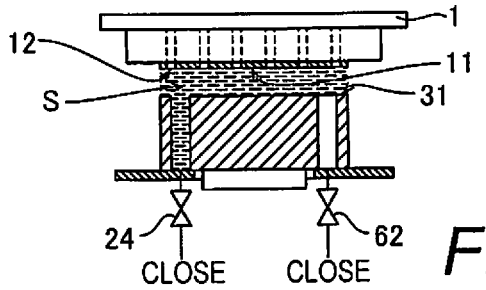

Step SW2 (the Situation in FIG. 5C)

This is a step of maintaining a state in which the liquid reservoir space S is filled with and holds the cleaning liquid for a certain length of time. When the pump valve 24 is closed and the collection valve 62 is closed, a state in which the cleaning liquid fills the liquid reservoir space S is maintained. Consequently, the nozzle face 11 of the inkjet head 1 and the ink discharge ports 12 in the nozzle face 11 are always covered with the cleaning liquid serving as a protective liquid, so ink or another such coating liquid can be prevented from evaporating or drying on the nozzle face 11 or the ink discharge ports 12. As a result, since clogging of the ink discharge ports 12 by solidified ink or the like can be prevented, extended standby and preservation are possible, and it is also possible to resume coating immediately after the standby is completed.

Figure 5D:
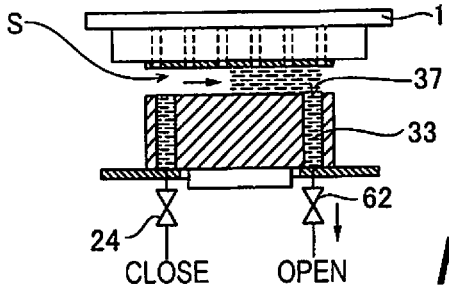

Step SW3 (the Situation in FIG. 5D)

This is a step of collecting the cleaning liquid, which is the protective liquid. The collection valve 62 is opened and the cleaning liquid filling the liquid reservoir space S is collected from the opening 37 of the liquid collection hole 33.

The collected cleaning liquid goes down through the liquid collection hole 33, the liquid collection pipe 61, and the collection valve 62, in that order and under the action of gravity, and finally drops into the main collection tray 63 and is collected.

Figure 5E:
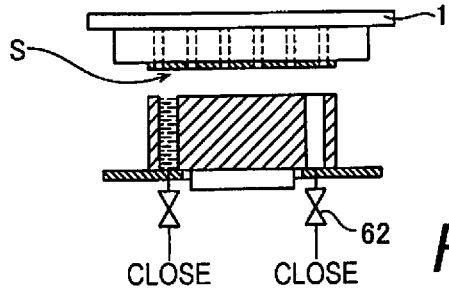

Step SW4 (the Situation in FIG. 5E)

This is a completion step. Once all the cleaning liquid has been collected from the liquid reservoir space S, the collection valve 62 is closed. The inkjet head 1 first rises up for the next step, and then moves to a specific place.

The cleaning liquid that filled the liquid reservoir space S may be held just as it is in step SW2, or fresh cleaning liquid may be supplied from the liquid supply hole 32 at some point, and the cleaning liquid in the liquid reservoir space S collected, thereby replacing the cleaning liquid in the liquid reservoir space S with fresh cleaning liquid as needed.

Executing the maintenance method comprising the above steps covers the ink discharge ports 12 and the nozzle face 11 of the inkjet head 1 with liquid and protects them, so the drying and evaporation that happen through contact with the air can be prevented over a very long time. Consequently, in addition to putting the device on standby for an extended period, long-term preservation and storage also becomes possible. Furthermore, it is also possible to resume using the inkjet head 1 immediately after these standby, preservation or storage. As the protective liquid, it is preferable to select a liquid that will not degrade the nozzle face 11 of the inkjet head 1 that has undergone a liquid repellency treatment. For example, as mentioned above, the cleaning liquid of the first embodiment (an organic solvent that dissolves dirt such as dried ink adhering to the nozzle face 11 of the inkjet head 1) may be used, or a different kind of liquid may be used.

Figure 6:
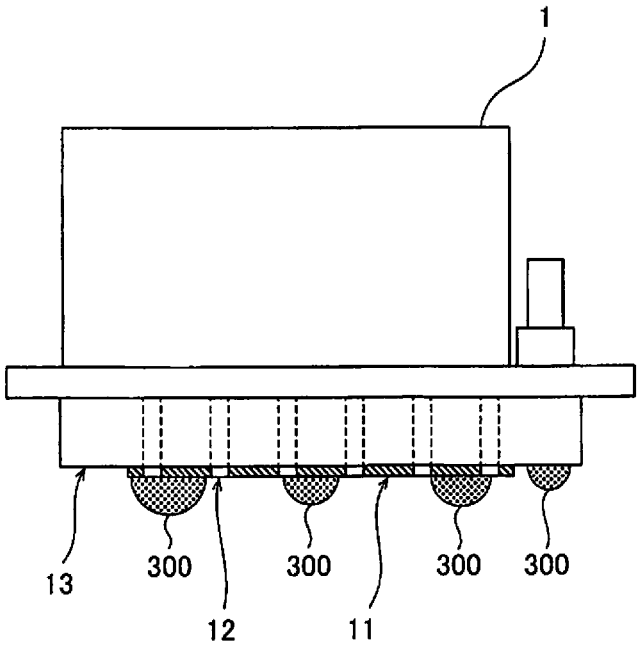
FIG. 6 is a front view of an inkjet head, and shows how coating liquid particles are generated during bleeding.

Next, an inkjet head bleeding method, which is yet another inkjet head maintenance method that makes use of the maintenance device 100*a* or the maintenance device 200*a*, will be described. In order to eliminate the clogging that occurs when foreign matter adheres to the ink discharge ports 12 of the inkjet head 1, etc., bleeding is performed by applying a high pressure and continuously pushing out the coating liquid in the inkjet head 1 from the ink discharge ports 12. Consequently, the coating liquid is discharged at high speed, and any foreign matter or the like adhering to the ink discharge ports 12 is also pushed out. The coating liquid and foreign matter are usually collected in a tray at a position below and away from the inkjet head 1, but some of the discharged coating liquid does not fall downward and instead flows along the nozzle face 11. As shown in FIG. 6, the coating liquid that flows in this way becomes coating liquid particles 300 of various sizes, which remain in the form of hanging down from the nozzle face 11 of the inkjet head 1 and from the lower end face 13 therearound. In order to remove these remaining coating liquid particles 300, conventionally, a dedicated removal device was required. With the inkjet head bleeding method that is another inkjet head maintenance method according to the present invention, bleeding is performed without generating these coating liquid particles 300, and the coating liquid, foreign matter, etc., discharged from the inkjet head 1 are collected during bleeding.

This inkjet head bleeding method will be described through reference to FIGS. 7A to 7F. FIGS. 7A to 7F are diagrams illustrating an inkjet head bleeding method, and FIGS. 7A to 7F are front cross sections (as seen in the Y direction) showing detail views of a part of the inkjet head 1 and the base 3 shown in FIG. 1, and the surrounding area. Also, the situation during each step and the results of the operation of the various components are shown in corresponding diagrams, with steps SB0 to SB5 corresponding to FIGS. 7A to 7F. As with the other maintenance methods, in the steps SB, a larger numerical value means that the step is carried out later in time. Carrying out the steps SB whose execution states are shown in FIGS. 7A to 7F corresponds to performing an inkjet head maintenance method that includes a step of discharging a coating liquid from the inkjet head 1 and holding it in the liquid reservoir space S, and a step of collecting the coating liquid held in the liquid reservoir space S from the collection hole 33. The steps SB in FIGS. 7A to 7F will now be described in order.

Figure 7A:
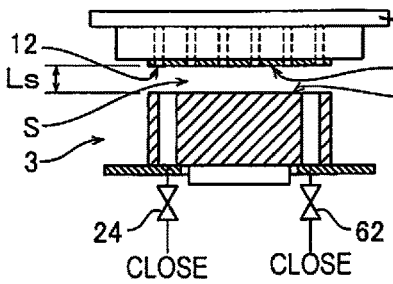
FIGS. 7A, 7B, 7C, 7D, 7E and 7F are diagrams illustrating the steps included in yet another inkjet head maintenance method according to the present invention.

Step SB0 (the Situation in FIG. 7A)

This is a preparatory step for carrying out an inkjet head bleeding method, which is another maintenance method of the present invention. The inkjet head 1 moves to a position directly above the upper face 31 of the base 3 and briefly stops there in order to bleed the system. Then, the inkjet head 1 is lowered in the vertical direction, and the inkjet head 1 is stopped at a position where the gap between the upper face 31 and the nozzle face 11 is the length Ls. Consequently, a liquid reservoir space S having a gap of the length Ls is formed between the upper face 31 and the nozzle face 11. At this point, both the pump valve 24 and the collection valve 62 are closed. The cleaning liquid fills everything from the storage tank 21 to the pump 22 and the pump valve 24 of the liquid supply pipe 23, and if the pump valve 24 is opened and the pump 22 is driven in this state, the cleaning liquid can be pumped to the base 3 at any time.

Figure 7B:
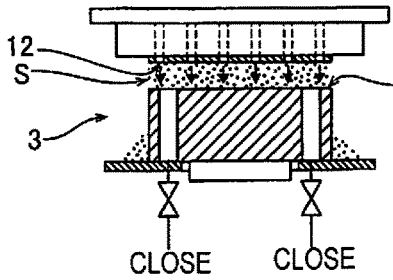
Figure 7C:
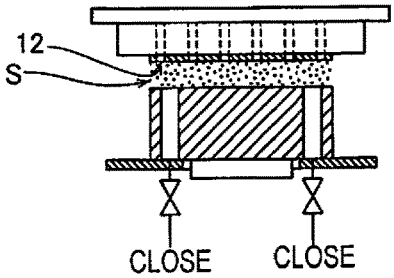

Step SB1 (the Situation in FIGS. 7B and 7C)

This is a step of bleeding. The coating liquid is supplied to the inkjet head 1, and the coating liquid is discharged from the ink discharge ports 12 at a specific flow rate (liquid volume per unit of time). The coating liquid discharged from the ink discharge ports 12 fills the liquid reservoir space S, and any excess coating liquid beyond the capacity of the liquid reservoir space S leaks out from the upper face 31 of the base 3 (the state shown in FIG. 7B). The leaked coating liquid is first collected in the sub-collection tray 81, and then collected in the main collection tray 63. Any foreign matter discharged along with the coating liquid follows the same path and is also collected in the sub-collection tray 81 or the main collection tray 63. At the point when the discharge of the coating liquid from the ink discharge ports 12 ends, the last discharged coating liquid remains in the liquid reservoir space S and is held there (the state shown in FIG. 7C). In the above steps, the coating liquid discharged from the ink discharge ports 12 is first held in the liquid reservoir space S, and then leaks out from the upper face 31 of the base 3, so the coating liquid does not flow to the lower end face 13 or the nozzle face 11 of the inkjet head, and no coating liquid particles 300 are formed whatsoever (see FIG. 6).

Figure 7D:
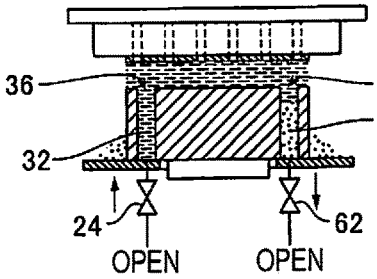

Step SB2 (the Situation in FIG. 7D)

This is a step of replacing the coating liquid filling the liquid reservoir space S with cleaning liquid. This replacement brings the cleaning liquid into contact with the nozzle face 11, an advantage of which is that any dirt on the nozzle face 11 is separated and goes into the cleaning liquid, which means that the nozzle face 11 can be cleaned. First, the pump 22 is driven to open the pump valve 24, and then the cleaning liquid is pumped to the liquid reservoir space S from the opening 36 of the liquid supply hole 32 at the flow rate Q3. Immediately after this, the collection valve 62 is opened, and the coating liquid in the liquid reservoir space S is collected from the opening 37 and the liquid collection hole 33 (the state shown in FIG. 7D). After a specific length of time, the collection valve 62 is closed, and collection from the opening 37 and the liquid collection hole 33 is concluded. Following this, the pump valve 24 is closed, the pump 22 also stops, and the supply of the cleaning liquid is ended. Simultaneously supplying the fresh cleaning liquid to the liquid reservoir space S and collecting the coating liquid effectively replaces the coating liquid filling the liquid reservoir space S with the cleaning liquid that has been freshly pumped in. That is, near the opening 36, the coating liquid that fills the liquid reservoir space S leaks out and is discharged from the edge of the upper face 31 of the base 3, being pushed out by the cleaning liquid that is freshly pumped in, and is collected from the sub-collection tray 81 in the main collection tray 63. Meanwhile, at a position farther away from the opening 36, the coating liquid that fills the liquid reservoir space S is pushed along the upper face 31 toward the opening 37 of the liquid collection hole 33 by the fresh cleaning liquid supplied from the opening 36, and as a result the coating liquid in the liquid reservoir space S is replaced with fresh cleaning liquid. In conjunction with this, the coating liquid filling the liquid reservoir space S is discharged from the opening 37 through the liquid collection hole 33 and collected in the main collection tray 63. The state in which the cleaning liquid fills the liquid reservoir space S (held state) is maintained for a certain length of time.

Figure 7E:
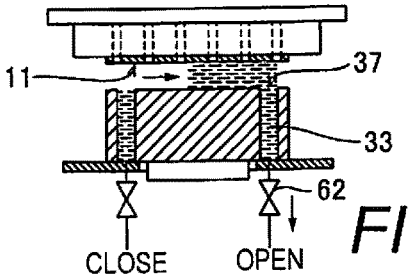

Step SB3 (the Situation in FIG. 7E)

This is a cleaning liquid collection step. The collection valve 62 is opened and the cleaning liquid that fills the liquid reservoir space S is collected from the opening 37 of the liquid collection hole 33. The collected cleaning liquid passes through the liquid collection hole 33 under the action of gravity and finally falls into and is collected in the main collection tray 63. At the end of collection, no cleaning liquid whatsoever remains on the nozzle face 11.

Figure 7F:
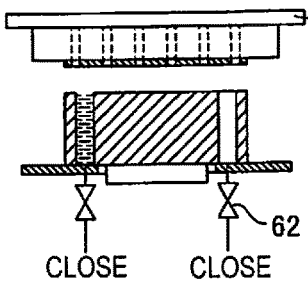

Step SB4 (the Situation in FIG. 7F)

This is a completion step. Once all the cleaning liquid has been collected from the liquid reservoir space S, the collection valve 62 is closed. Then, the inkjet head 1 first rises for the next step, and then moves to a specific place.

If the maintenance method for the inkjet head 1 in FIGS. 7A to 7F is carried out, even if bleeding is performed in which the coating liquid is discharged from the inkjet head at a high speed in order to eliminate clogging by removing any foreign matter adhering to the ink discharge ports 12 of the inkjet head 1, and to prevent any further clogging from occurring, the coating liquid particles 300 shown in FIG. 6 will not be generated on the nozzle face 11, etc. Also, the discharged coating liquid can be collected without adhering to and remaining on the nozzle face 11 or the like, without any coating liquid particles 300 being generated. Furthermore, after bleeding, any coating liquid remaining in the liquid reservoir space S is first replaced with cleaning liquid, and then that cleaning liquid is collected, so the nozzle face 11 and the ink discharge ports 12 can also be cleaned at the same time.

In the above steps, SB2 may be omitted, giving as SB0→SB1→SB3→SB4, and the coating liquid that fills and is held in the liquid reservoir space S may be collected immediately after bleeding. Furthermore, as with the steps SB0→SB1→SB3→SB2→SB3→SB4, the coating liquid remaining in the liquid reservoir space S may be collected immediately after bleeding, then the liquid reservoir space S filled with cleaning liquid and kept there for a specific length of time, and the cleaning liquid then collected after cleaning. Step SB2 in this case may be changed to the above step S1. Either way, it is possible to eliminate clogging of the inkjet head or prevent its occurrence by performing the bleeding without generating any coating liquid particles. Furthermore, as with the steps SB0→SB2→SB1→SB2→SB3→SB4 or SB0→SB2→SB1→SB3→SB4, bleeding may be performed by discharging the coating liquid from the inkjet head after filling the liquid reservoir space S with the cleaning liquid. In this case, the cleaning liquid already held in the liquid reservoir space S is first replaced with coating liquid, but since this also does not generate any coating liquid particles 300 on the nozzle face 11, etc., so this is an effective method. The first step SB2 in this case may be changed to the above step S1.

Modification Examples

The embodiments disclosed herein are examples in all respects and are not limiting in nature. The scope of the present invention is indicated not by the description of embodiments, but by the scope of the claims. Furthermore, all changes (modification examples) within the meaning and range of equivalency of the claims are included.

In the first and second embodiments, an example is given in which the liquid supply hole 32 and the liquid collection hole 33 are provided near the end that is directly opposite the base 3 in the X direction, but the present invention is not limited to this. For example, one of them may be provided near the center of the base 3. Furthermore, they may be arranged close to each other, and they may be disposed anywhere, such as at the end, the center part, or the like of the base 3. It is also possible to form one hole that serves as both the liquid supply hole 32 and the liquid collection hole 33.

Furthermore, in the first and second embodiments, an example was given in which the heating means 4 was provided for heating the upper face 31 of the base 3, but the heating means 4 need not be provided. Also, the heating means 4 may be provided on the inside of the base 3 rather than the outside. In this case, it is preferable to use a cartridge heater or a fluid that will serve as a heat medium.

Also, in the second embodiment, the collection attracting member 51, which is a guide member, may be thread shaped, but more specifically it may be a metal wire, a wire, a cable, a fiber, a staple, a twisted strand, or the like.

The invention claimed is:

1. An inkjet head maintenance device, comprising:

a base with an upper face disposed closely opposite a nozzle face of an inkjet head to form a liquid reservoir space during maintenance of the inkjet head, the base including a liquid supply hole and a liquid collection hole that open to the upper face;

a liquid supplier configured to supply liquid from the liquid supply hole to the liquid reservoir space to clean the nozzle face of the inkjet head with the liquid held in the liquid reservoir space; and a liquid collector configured to collect the liquid in the liquid reservoir space from the liquid collection hole, the base including a liquid collection accelerator configured to accelerate collection of the liquid.

2. The inkjet head maintenance device according to claim 1, wherein the liquid collection accelerator is configured to draw the liquid toward the liquid collection hole, the liquid collection accelerator including a first portion on an outside of the liquid collection hole and a second portion on an inside of the liquid collection hole, and the first portion is continuous with the second portion.

3. The inkjet head maintenance device according to claim 2, further comprising a leaked liquid receptacle configured to collect the liquid that leaks out from the liquid reservoir space.

4. The inkjet head maintenance device according to claim 3, further comprising a heater configured to heat the upper face of the base.

5. The inkjet head maintenance device according to claim 2, further comprising a heater configured to heat the upper face of the base.

6. An inkjet head maintenance method, in which the inkjet head maintenance device according to claim 1 is used, the method comprising:

supplying a cleaning liquid for cleaning the nozzle face of the inkjet head from the liquid supply hole, and holding the cleaning liquid in the liquid reservoir space; and collecting the cleaning liquid held in the liquid reservoir space from the liquid collection hole.

7. The inkjet head maintenance method according to claim 6, wherein the supplying of the cleaning liquid from the liquid supply hole and the collecting of the cleaning liquid from the liquid collection hole are performed simultaneously.

8. The inkjet head maintenance device according to claim 1, further comprising a heater configured to heat the upper face of the base.

9. An inkjet head maintenance method, in which the inkjet head maintenance device according to claim 1 is used, the method comprising:

discharging a coating liquid from the inkjet head and holding the coating liquid in the liquid reservoir space; and collecting the coating liquid held in the liquid reservoir space from the liquid collection hole.

10. The inkjet head maintenance device according to claim 1, further comprising a leaked liquid receptacle configured to collect the liquid that leaks out from the liquid reservoir space.

11. The inkjet head maintenance device according to claim 10, further comprising a heater configured to heat the upper face of the base.

12. An inkjet head maintenance device, comprising:

a base with an upper face disposed closely opposite a nozzle face of an inkjet head to form a liquid reservoir space during maintenance of the inkjet head, the base including a liquid supply hole and a liquid collection hole that open to the upper face;

a liquid supplier configured to supply liquid from the liquid supply hole to the liquid reservoir space to clean the nozzle face of the inkjet head with the liquid held in the liquid reservoir space;

a liquid collector configured to collect the liquid in the liquid reservoir space from the liquid collection hole; and a leaked liquid receptacle configured to collect the liquid that leaks out from the liquid reservoir space.

13. The inkjet head maintenance device according to claim 12, further comprising a heater configured to heat the upper face of the base.

14. An inkjet head maintenance device, comprising:

a base with an upper face disposed closely opposite a nozzle face of an inkjet head to form a liquid reservoir space during maintenance of the inkjet head, the base including a liquid supply hole and a liquid collection hole that open to the upper face;

a liquid supplier configured to supply liquid from the liquid supply hole to the liquid reservoir space to clean the nozzle face of the inkjet head with the liquid held in the liquid reservoir space;

a liquid collector configured to collect the liquid in the liquid reservoir space from the liquid collection hole; and a heater configured to heat the upper face of the base.

15. An inkjet head maintenance method, in which an inkjet head maintenance device including a base with an upper face disposed closely opposite a nozzle face of an inkjet head to form a liquid reservoir space during maintenance of the inkjet head, the base including a liquid supply hole and a liquid collection hole that open to the upper face, a liquid supplier configured to supply liquid from the liquid supply hole to the liquid reservoir space to clean the nozzle face of the inkjet head with the liquid held in the liquid reservoir space, and a liquid collector configured to collect the livid in the liquid reservoir space from the liquid collection hole, is used, the method comprising:

supplying a protective liquid for protecting the nozzle face of the inkjet head from the liquid supply hole, and holding the protective liquid in the liquid reservoir space; and collecting the protective liquid after a certain amount of time has passed after holding the protective liquid.

* * * * *